US007586044B2

(12) United States Patent
Kensicher et al.

(10) Patent No.: US 7,586,044 B2
(45) Date of Patent: Sep. 8, 2009

(54) CABLE INCLUDING A PLURALITY OF INSULATED CONDUCTORS ENCLOSED IN THE SAME SHEATH AND METHOD OF FABRICATING THIS KIND OF CABLE

(75) Inventors: Christele Kensicher, Lyons (FR); Patrick Odot, Autun (FR)

(73) Assignee: Nexans, Paris (FR)

( * ) Notice: Subject to any disclaimer, the term of this patent is extended or adjusted under 35 U.S.C. 154(b) by 627 days.

(21) Appl. No.: 11/143,097

(22) Filed: Jun. 2, 2005

(65) Prior Publication Data

US 2005/0274539 A1 Dec. 15, 2005

(30) Foreign Application Priority Data

Jun. 7, 2004 (FR) ..... 04 06090

(51) Int. Cl.
*H01B 7/00* (2006.01)

(52) U.S. Cl. ..... 174/113 R; 174/120 R

(58) Field of Classification Search ..... 174/120 R, 174/113 R

See application file for complete search history.

(56) References Cited

U.S. PATENT DOCUMENTS 4,877,827 A * 10/1989 Van Der Groep ..... 524/477
5,059,651 A * 10/1991 Ueno ..... 524/424
6,218,621 B1 * 4/2001 Kuczynski ..... 174/110 R
6,392,153 B1 * 5/2002 Horwatt et al. ..... 174/110 R

FOREIGN PATENT DOCUMENTS

EP 1176612 A2 1/2002 ..... 7/4
GB 2161644 * 1/1986

OTHER PUBLICATIONS

French Search Report Jan. 25, 2005.

* cited by examiner

*Primary Examiner*—Chau N Nguyen
(74) *Attorney, Agent, or Firm*—Sofer & Haroun, LLP

(57) ABSTRACT

The present invention relates to a cable 1 comprising two or more insulated conductors 2*s* grouped together in a common sheath 3, each insulated conductor 2 comprising a conductive member 4 inside an insulative member 5. The invention is noteworthy in that each insulated conductor 2 is covered with a skin 6 that is attached to the insulative member 5 and is non-stick with reference to the sheath 3.

14 Claims, 1 Drawing Sheet

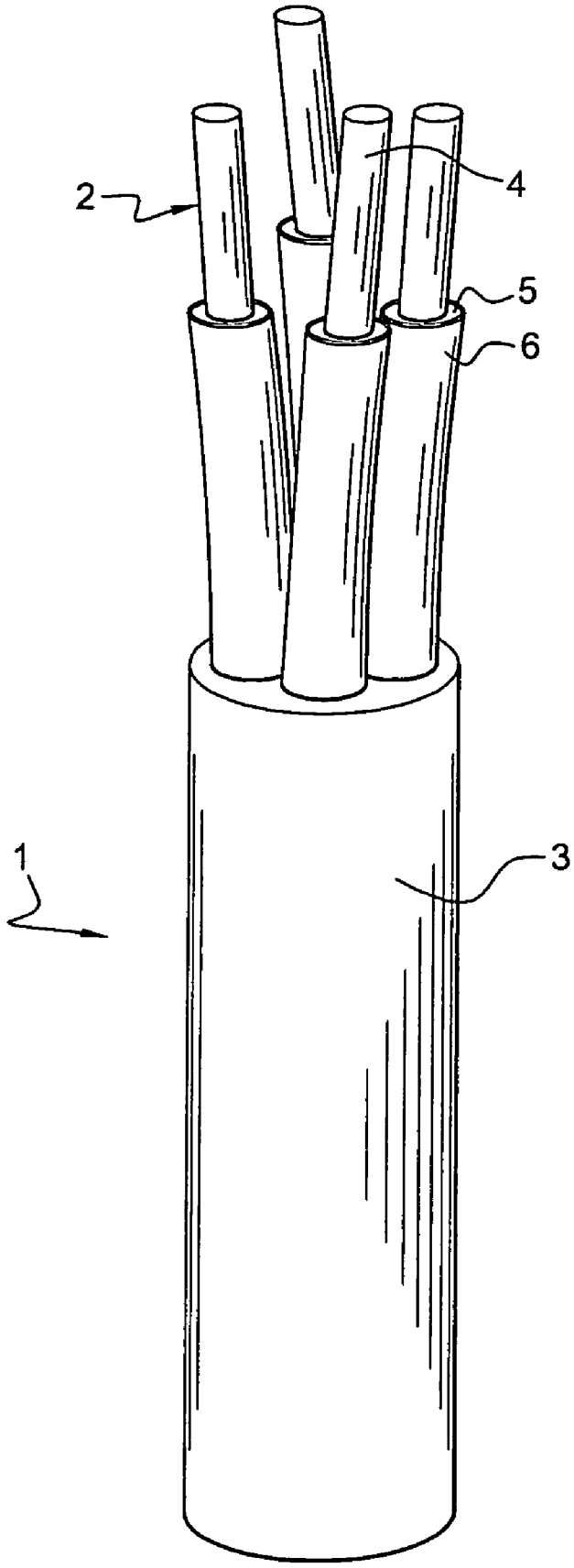
2
4
5
6
1
3

CABLE INCLUDING A PLURALITY OF INSULATED CONDUCTORS ENCLOSED IN THE SAME SHEATH AND METHOD OF FABRICATING THIS KIND OF CABLE

RELATED APPLICATION

This application is related to and claims the benefit of priority from French Patent Application No. 04 06090, filed on Jun. 4, 2005, the entirety of which is incorporated herein by reference.

FIELD OF THE INVENTION

The present invention relates to a cable consisting of a plurality of insulated conductors inside the same protective sheath.

The invention also relates to a method of fabricating this kind of cable.

The invention finds a particularly advantageous, although not exclusive, application in the field of power and/or telecommunication cables.

Note that, throughout the present text, the expression "insulated conductor" refers very generally to any electrically conductive member covered with an electrically insulative member. It is also to be understood that the conductive member and/or the insulative member can have a simple or composite structure. Thus the conductive member can consist of a plurality of independent or non-independent electrical conductors and the insulative member can consist of a plurality of superposed insulative layers.

BACKGROUND

Be this as it may, grouping a plurality of insulated conductors in the same sheath to constitute a single cable is known in the art. This kind of assembly is usually produced by extruding the sheath around the various insulated conductors assembled into a bundle beforehand.

However, this type of fabrication method has the drawback that the sheath and each insulated conductor stick together. During extrusion, the sheath material is in fact used in the molten state and is brought directly into contact with the insulative material of each insulated conductor. The resulting adhesion between the materials in question makes the cable particularly difficult to strip afterwards. This problem is particularly acute given that the sheath at the end of the cable must be systematically removed when a connection is envisaged.

One prior art solution to this problem of adhesion is to cover the exterior surface of each insulated conductor with talc before extruding the sheath. However, this operation proves somewhat impractical, essentially because of the powdery nature of the talc, which makes any manipulation difficult and inevitably causes soiling. In the final analysis, this represents a penalty on the productivity of the entire cable fabrication line. Applying this non-stick material also requires the use of dedicated equipment, which has a negative impact on the unit cost of the cable.

Another solution to avoiding the phenomenon of the sheath and the insulated conductors sticking to each other is to coat the exterior surface of each insulative member with an emulsion based on silicone. However, this operation proves no more practical to implement than the previous one, this time because of the oily consistency of the non-stick material, which makes application just as difficult and produces just as much soiling as the solution previously referred to. Moreover, dedicated equipment is again needed. In the final analysis, the consequences in terms of productivity and unit cost are substantially identical to those inherent to the use of the first solution.

OBJECTS AND SUMMARY

Accordingly, the technical problem to be solved by the subject matter of the present invention is that of proposing a cable comprising two or more insulated conductors grouped together in a common sheath, each insulated conductor comprising a conductive member inside an insulative member, that would avoid the problems of the prior art and would be substantially less costly to fabricate and easy to strip.

The solution in accordance with the present invention to the stated technical problem is that each insulated conductor is covered with a skin that is attached to the insulative member and is non-stick with reference to the sheath.

In the present context, the term "skin" refers to an extremely thin layer that envelops an individual insulated conductor and adheres strongly to the external surface of the corresponding insulative member, with which surface said layer cooperates through intimate contact. However, in the present context this skin also has the advantageous property of not adhering to the internal surface of the sheath. The latter can therefore be stripped very easily, without degrading the integrity of the insulated conductors.

The invention also relates to a method of fabricating a cable as defined above. This method is noteworthy in that it includes the following steps:

- extruding the insulative member around each conductive member to constitute each insulated conductor,
- extruding around each insulated conductor a skin that is attached to the corresponding insulative member and that is non-stick with reference to the sheath, and
- extruding the sheath around all of the insulated conductors previously assembled into a bundle.

Thus the invention as defined above has the advantage of being significantly easier to put into practice than the prior art solutions, since it necessitates only conventional cable fabrication equipment, in this instance extrusion equipment. The solution consisting in interleaving a skin should therefore allow a productivity improvement of the order of 10% at the same time as guaranteeing non-adhesion between the sheath and the various insulated conductors.

The present invention also relates to the features that will emerge during the course of the following description and that should be considered individually as well as in all technically feasible combinations.

BREIF DESCRIPTION OF THE DRAWINGS

This description, which is intended to explain how the invention may be put into effect, is given by way of non-limiting example and with reference to the single FIGURE which shows a cable according to the invention.

DETAILED DESCRIPTION

For clarity, the same items are designated by identical reference numbers. Similarly, only items essential for understanding the invention are represented, diagrammatically and not to scale.

The single FIGURE therefore shows a cable 1 comprising four insulated conductors 2 that are grouped within the same protective sheath 3. In this embodiment, each insulated conductor 2 consists of a copper conductive member 4 inside a polymer insulative member 5.

In accordance with the present invention, each insulated conductor 2 is also covered with a skin 6 that is attached to its insulative member 5 and which is non-stick with respect to the sheath 3.

At this stage, and provided that the skin 6 actually has a good capacity for adhesion to each insulative member 5 and good non-stick properties with respect to the sheath 3, any combination of materials may be envisaged for the various members intended to be in contact within the cable, namely each of said insulative members 5, said skin 6 and said sheath 3.

It is particularly advantageous if each skin 6 has a thickness from 0.05 mm to 0.2 mm.

Here the only function of the skin 6 is to constitute an interface between each insulated conductor 2 and the sheath 3. This explains why its thickness is so small compared to that of each insulative member 5 and/or that of the sheath 3, which are of the order of one millimeter.

In a first embodiment of the invention, each skin 6 is based on polypropylene.

Used substantially pure, this plastics material has the advantage of offering significant non-stick properties with respect to most of the materials that are commonly used for the sheaths 3 in the cablemaking field. Moreover, as the melting point of polypropylene is higher than the temperature at which the sheath materials in question are worked, there is no risk of bonding during the formation of the sheath 3. On the other hand, to ensure good adhesion between the polypropylene and each insulated conductor 2, the skin 6 is advantageously formed at the same time as the corresponding insulative member 5; attachment is then effected by surface interpenetration of the two types of material.

According to one particular feature of this first embodiment, each insulative member 5 is further based on a cross-linked polyolefin and the sheath 3 is based on a charged polyolefin.

In other words, each insulative member 5 is made from a composition including a polyolefin that can be cross-linked. The sheath 3 is made from a polyolefin matrix in which an organic charge is dispersed, independently of the function thereof.

Here each insulative member 5 is based on cross-linked polyethylene, which is particularly advantageous.

According to another advantageous feature, the sheath 3 is based on a mixture of ethyl vinyl acetate and polyethylene.

Any relative proportions of the two constituents of the mixture intended to form the sheath 3 may be envisaged a priori. The composition of the sheath in question can even incorporate an organic charge in the conventional way.

However, in a second embodiment of the invention, each skin 6 may also be based on a mixture of polypropylene and polyvinyl chloride.

In this case, the proportion of polypropylene relative to the polyvinyl chloride in the mixture constituting the skin 6 may advantageously vary from 5% to 30%.

According to one particular feature of this second embodiment, each insulative member 5 is based on a halogenated polymer and the sheath 3 is based on a charged halogenated polymer.

It is particularly advantageous if each insulative member 5 is based on polyvinyl chloride.

According to another advantageous feature, the sheath 3 is based on charged polyvinyl chloride.

Note that polypropylene and polyvinyl chloride are not compatible a priori, in the sense that in theory adhesion is possible between these two types of plastics material, in particular through interpenetration in the molten state. It is nevertheless found that a skin 6 consisting of a mixture of polypropylene and polyvinyl chloride as defined above is advantageously able to adhere to an insulative member 5 of polyvinyl chloride if the materials in question are brought into contact in the molten state. Accordingly, for there to be no adhesion between this skin 6 and a polyvinyl chloride sheath 3, it suffices to deposit the latter only after said skin 6 is no longer in the molten state.

The composition of the sheath 3 is preferably charged with chalk. The essential object of this feature is to reduce the unit cost of the sheath 3.

In this case, the composition of the sheath 3 may advantageously further contain a plasticizer.

The invention also relates to a method of fabricating a cable 1 comprising two or more insulated conductors 2 grouped together in the same sheath 3, each insulated conductor 2 comprising a conductive member 4 inside an insulative member 5.

This fabrication method is noteworthy in that it includes the steps of:

- extruding the insulative member 5 around each conductive member 4 to constitute each insulated conductor 2,
- extruding onto each insulated conductor 2 a skin 6 that is attached to the insulative member 5 and that is non-stick with reference to the sheath 3, and
- extruding the sheath 3 around all of the insulated conductors 2 previously assembled into a bundle.

The cable of the invention may therefore be produced on conventional extrusion equipment, which is particularly advantageous in terms of fabrication cost, compared to the prior art methods that require costly dedicated equipment.

According to one particular feature of this fabrication method, each skin 6 is extruded at the same time as the corresponding insulative member 5.

Note that in the field of cablemaking it is relatively standard practice to employ co-extrusion, in particular when it is required to color an insulative member economically. This means that many extruding machines have the capability to deposit a thin layer of polymer on the surface of an insulative member. These machines may therefore be used with advantage to form the skin 6 on the surface of each insulated conductor 2.

The invention claimed is:

1. Cable comprising:

two or more insulated conductors grouped together in a common sheath, each insulated conductor having a conductive member inside an insulative member, wherein each insulated conductor is covered with a skin that is adhered to the insulative member and is non-stick with reference to the sheath.

2. Cable according to claim 1, wherein each skin has a thickness from 0.05 mm to 0.2 mm.

3. Cable according to claim 1, wherein each skin is based on polypropylene.

4. Cable according to claim 1, wherein each insulative member is based on a cross-linked polyolefin and in that the sheath is based on a charged polyolefin.

5. Cable according to claim 4, wherein each insulative member is based on cross-linked polyethylene.

6. Cable according to claim 4, wherein the sheath is based on a mixture of ethyl vinyl acetate and polyethylene.

7. Cable according to claim 1, wherein each skin is based on a mixture of polypropylene and polyvinyl chloride.

8. Cable according to claim 7, wherein the proportion of polypropylene in the mixture constituting the skin is from 5% to 30%.

9. Cable according to claim 7, wherein each insulative member is based on a halogenated polymer and in that the sheath is based on a charged halogenated polymer.

10. Cable according to claim 9, wherein each insulative member is based on polyvinyl chloride.

11. Cable according to claim 9, wherein the sheath is based on charged polyvinyl chloride.

12. Cable according to claim 9, wherein the composition of the sheath is charged with chalk.

13. Cable according to claim 9, wherein the composition of the sheath further includes a plasticizer.

14. Cable comprising:

two or more insulated conductors grouped together in a common sheath each insulated conductor having a conductive member inside an insulative member, wherein each insulated conductor is covered with a skin that is adhered to the insulative member and is non-stick with reference to the sheath, said skin allowing the sheath to be stripped without degrading the integrity of said insulated conductor.

* * * * *